United States Patent [19]

Schmeykal et al.

[11] Patent Number: 4,902,148

[45] Date of Patent: Feb. 20, 1990

[54] TYPEWRITER WITH A PRINT WHEEL AND HAMMER DRIVEN BY ONE MOTOR

[75] Inventors: Rudolf Schmeykal, Hemhofen; Johannes Haftmann, Schwabach, both of Fed. Rep. of Germany

[73] Assignee: Ta Triumph-Adler Aktiengesellschaft, Nuremberg, Fed. Rep. of Germany

[21] Appl. No.: 227,536

[22] Filed: Aug. 1, 1988

[30] Foreign Application Priority Data

Sep. 2, 1987 [DE] Fed. Rep. of Germany ..... 3729309

[51] Int. Cl.[4] ..... B41J 1/30

[52] U.S. Cl. ..... 400/144.2; 400/157.2; 400/185; 101/93.18

[58] Field of Search ..... 400/144.2, 144.3, 257, 400/157.2, 185; 101/93.48, 93.18, 93.19; 74/104; 318/115

[56] References Cited

U.S. PATENT DOCUMENTS

| | | | |
|---|---|---|---|
| 564,488 | 7/1896 | Johnson | 74/104 |
| 1,023,855 | 4/1912 | King et al. | 74/104 |
| 4,049,109 | 9/1977 | Plaza et al. | 400/144.2 |
| 4,099,106 | 7/1978 | Nikaido | 318/115 |
| 4,124,312 | 11/1978 | Johnson | 400/144.2 |
| 4,234,831 | 11/1980 | Kemmer et al. | 318/115 |
| 4,351,618 | 9/1982 | Prewarski | 400/257 |

FOREIGN PATENT DOCUMENTS

| | | |
|---|---|---|
| 3014286 | 10/1981 | Fed. Rep. of Germany . |
| 3538017 | 4/1987 | Fed. Rep. of Germany . |
| 57-56264 | 4/1982 | Japan . |

OTHER PUBLICATIONS

Arter, Bajgert & Wills, "Stepping Motor with Shaft To Translation", *IBM Technical Disclosure Bulletin*, vol. 26, No. 4, Sep. 83, pp. 1897–1898.

*Primary Examiner*—David A. Wiecking
*Attorney, Agent, or Firm*—Browdy & Neimark

[57] ABSTRACT

A typewriter or similar machine with a print wheel disposed on a shaft drivable by a motor, the characters of which are printed by means of a hammer. In accordance with the invention, use of a separate print magnet is to be omitted. This is made possible by the use of a lift-rotation motor. Its rotational movement is used for the rotational positioning of the print wheel, while the axial movement of the motor shaft is transferred to a print hammer pivotably disposed on the carriage. Determination of the engagement point of the motor shaft with the print hammer makes possible the optimum determination of the movement cycle of the print hammer as well as its print force. Thus the space above the motor for the print wheel, otherwise required for a print magnet, can be used for other purposes. Additionally there is a reduction of the masses which are required to be moved along the platen.

3 Claims, 1 Drawing Sheet

TYPEWRITER WITH A PRINT WHEEL AND HAMMER DRIVEN BY ONE MOTOR

BACKGROUND OF THE INVENTION

1. Field of the Invention

The invention relates to a typewriter or similar machine with a print wheel disposed on a shaft drivable by a motor, the characters of which a printed by means of a hammer.

2. The Prior Art

Customarily such typewriters are designed in such a way that the print wheel is either seated directly on the motor shaft or on a rotational positioning shaft which can be driven by a motor by means of a gear. Customarily a step motor is used as a motor. When the character selected for printing is in the print position, printing is accomplished via a microprocessor of the electronically controlled typewriter. In most of the known typewriters of this type printing is accomplished by a magnet, the striker of which acts directly or indirectly on the back of the spoke of the print wheel which carries the selected character. As a result, these known devices require a print magnet besides the motor for the rotational positioning of the print wheel. Thus there are two drives which are comparatively expensive. Furthermore two drives together represent a corresponding mass which must be moved by the motor moving the carriage along the platen. Accordingly this motor has to be of a corresponding size. In addition, the print magnet often is in a position in which it obscures the view of the printed text. On the other hand, such a print magnet often is in the way when either the ribbon or the print wheel is to be exchanged. Such a mechanism is shown, for example, in German Patent No. DE-PS 30 14 286. This a comparatively complicated design requiring many components, furthermore its assembly is expensive.

SUMMARY OF THE INVENTION

It is an object of the invention to provide a typewriter of the known species in which a print magnet is not required. Suitable for this is a device in which the drive for the rotational positioning of the print wheel and the pivotable movement of the hammer is in the form of a lift-rotation or reciprocation-rotation motor, and the hammer follows the axial movement of the shaft of the reciprocation-rotation motor. Suitable as a reciprocation-rotation motor is, for example, the one known from German Published, Non-Examined application No. DE-OS 35 38 017. Thus no additional drive for the hammer is required, besides the reciprocation-rotation motor. The space above the motor thus can be used in its entirety for the ribbon cassette or the correction tape. In this way it is also possible to provide for a larger ribbon capacity. Also, the mass of the carriage is reduced by the mass of the electromagnet for the print hammer. The provision for the interaction of a hammer with the spokes of the print wheel is also known from the previously mentioned German Patent No. DE-PS 30 14 286. Of course, care must be taken that the type wheel does not follow the axial movement of the reciprocation-rotation motor. For this purpose flanges may be provided by which the front and back of the print wheel can be supported. In order to reduce the friction between it and the flanges during the rotational positioning of the print wheel, the flanges can have rounded projections.

A preferred connection between the shaft of the motor and the print hammer is one in which disks are disposed on the shaft of the reciprocation-rotation motor on which abuts the hammer by means of arched surfaces. This connection has an advantage in that no separate parts need to be made and installed. Because the shaft of the reciprocation-rotation motor has a polygonal shape in the area of the print wheel, the normally used pick-up finger on the rotational positioning shaft which extends into a hole in the print wheel can be omitted. The rotational take-along of the print wheel is assured by the polygonal shape of the motor shaft.

Other customary devices, such as for example a print wheel cassette, if desired with integrated ribbon guidance, can of course also be realized, so that otherwise a typewriter according to the invention is in general not different from the customary ones, in particular as far as operation and handling are concerned.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The drawings show an exemplary embodiment of the invention in a schematic view, in which.

DETAILED DESCRIPTION OF THE PREFERRED EMBODIMENT

Figure 1:
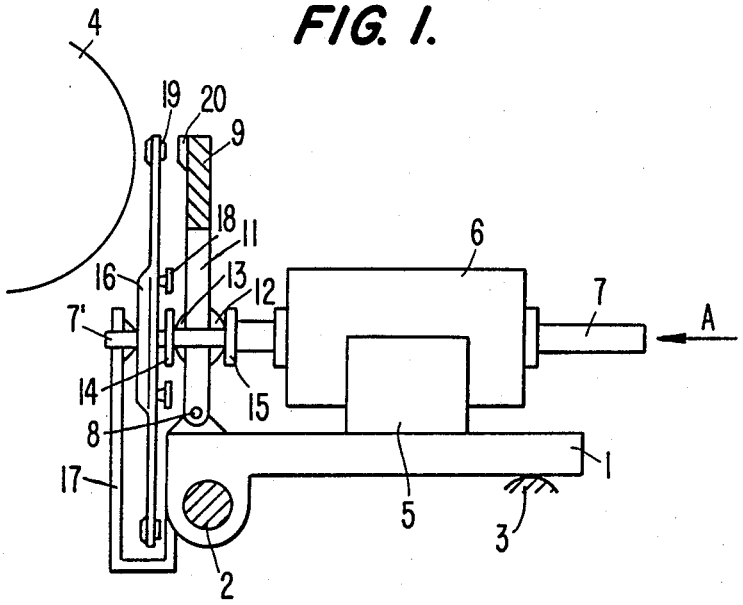
FIG. 1 is a side view of a print wheel carriage, showing the print hammer in a cut view, but without the ribbon cassette and its support.
Figure 2:
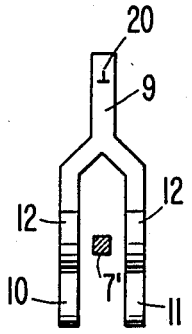
FIG. 2 is a view of the print hammer in the direction of view towards the platen.

The carriage 1 is, as is customary with such typewriters, slideable in the guides 2 and 3 along the platen 4. A motor, not shown, which causes the movement of the carriage by means of a pull wire, is used for this. The reciprocation-rotation motor 6 is fastened to the carriage on a support 5. Its shaft 7 is rotatably and axially displaceable.

A joint 8 in which the hammer 9 is pivotably placed, is also disposed on the carriage 1. The hammer 9 is approximately in the shape of an inverted letter Y, the two legs 10 and 11 serving to seat the hammer 9. At the legs 10, 11 of the hammer 9 rounded or arched surfaces 12 and 13 are provided on which abut disks 14 and 15 which are disposed on the motor shaft 7. The thickening formed by the arched surfaces 12 and 13 is as great as the distance between the disks 14 and 15. This results in the hammer being confined without play between the two disks 14 and 15 and in this way it can assuredly follow the axial movement of the motor shaft 7.

The motor shaft 7 is provided with a polygonal shape in an area designated by 7'. This may be a square, a rectangle or a triangle. The print wheel 16 is pushed onto this polygonal shape and thus it surely follows the rotation of the shaft. Flanges 17 and 18 having rounded projections are provided on the carriage 1. The disposition of the flanges is such that the print wheel 16 is located between them and is supported with its front and back on the respective flanges. This assures that the print wheel itself cannot follow the axial movement of the motor shaft 7. As is customary, centering wedges 19 may also be provided on the spokes of the print wheel 16 which cooperate with an opposite section 20 of the print hammer 9.

Rotational positioning of the print wheel 9 takes place by powering the reciprocation-rotation motor 6 in the customary way. When the print wheel 16 has assumed the desired position, i.e. the selected character is located in the print position with respect to the platen 4, the power supply to the reciprocation-rotation motor 6 is changed in such a way that the motor shaft 7 makes an axial movement in the direction of the arrow A. Because of this the print hammer 9 is pivoted around its joint 8 so that the character in the print position is printed. After printing, the motor shaft 7 is reversed so that the print hammer 9 disengages from the print wheel 16 and the latter can make a new rotational positioning move.

The drawing, in particular FIG. 1, illustrates that by means of the selection of the engagement point at the print hammer 9 of the disks 14 and 15 of the motor shaft 7 a transmission ratio for the print hammer can be achieved which results in advantageous acceleration values and corresponding print force. Because of this the axial movement of the motor shaft 7 can be kept within acceptable limits. FIG. 1 also illustrates that the space above the reciprocation-rotation motor 6, otherwise required for a print magnet, can be used for other purposes, for example for an enlarged ribbon cassette. For reasons of simplification of the drawing the representation of a pivot device, which makes it possible to exchange the print wheel 16 with ease, was omitted. Such pivot devices, however, are part of the state of the art and can easily be used in a present device.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A typewriter or similar machine comprising:

a print wheel having a plurality of characters thereon;

a hammer for printing the characters on the print wheel; and means including a reciprocation-rotation motor, having a shaft, for driving the rotational positioning of the print wheel by rotation of the shaft and for driving the pivoting movement of the hammer by the axial movement of the shaft to directly cause the hammer to impact the print wheel to print.

2. The typewriter according to claim 1, further comprising:

disks disposed on the shaft of the reciprocation-rotation motor; and arched surfaces on each side of the hammer which abut the disks.

3. The typewriter according to claim 1, wherein the shaft of the reciprocation-rotation motor has a polygonal shape in an area near the print wheel.

* * * * *